United States Patent [19]

Falls et al.

[11] Patent Number: 4,667,747

[45] Date of Patent: May 26, 1987

[54] NAIL STARTER

[76] Inventors: Jack L. Falls, P.O. Box 291, Ione, Wash. 99139; George Spector, 233 Broadway RM 3815, New York, N.Y. 10007

[21] Appl. No.: 766,983

[22] Filed: Aug. 19, 1985

[51] Int. Cl.[4] ..... B25D 9/00

[52] U.S. Cl. ..... 173/90; 81/23; 81/44

[58] Field of Search ..... 173/90, 94, 98; 227/81, 227/119, 139, 147, 154, 113, 141, 144; 81/23, 24, 44

[56] References Cited

U.S. PATENT DOCUMENTS

| | | | |
|---|---|---|---|
| 304,618 | 9/1884 | Cullen | 81/23 |
| 1,410,801 | 3/1922 | Erickson | 81/23 |
| 1,688,537 | 10/1928 | Fahrenbruch | 81/23 |
| 3,765,588 | 10/1973 | Fredrickson | 227/113 |
| 4,221,248 | 9/1980 | Rix | 81/44 |
| 4,422,489 | 12/1983 | Ross | 81/44 |

*Primary Examiner*—E. R. Kazenske
*Assistant Examiner*—Willmon Fridie, Jr.

[57] ABSTRACT

A nail holder is provided and consists of an elongated bent body member and a magnetic head having a V-shaped slot therein which employs a magnetic field of a magnet to hold a nail in the V-shaped slot so that the nail can be driven into a surface area by a hammer.

2 Claims, 4 Drawing Figures

NAIL STARTER

BACKGROUND OF THE INVENTION

The instant invention relates generally to construction tool implements and more specifically it relates to a nail holder to assist a person in hammering nails into a surface area.

Numerous construction tool implements have been provided in prior art that are adapted to hold nails and the like in position for striking with a hammer. For example, U.S. Pat. Nos. 3,060,442; 3,729,035 and 4,422,489 all are illustrative of such prior art. While these units may be suitable for the particular purpose to which they address, they would not be as suitable for the purpose of the present invention as heretofore described.

SUMMARY OF THE INVENTION

A principle object of the present invention is to provide a nail holder which employs a magnetic field of a magnet to hold a nail in a V-shaped slot so that the nail can be driven into a surface area by a hammer.

Another object is to provide a nail holder in which the nail can be slid into the V-shaped slot to pin point the nail at dead center in either an overhead, vertical or horizontal position.

An additional object is to provide a nail holder that has a built in hammering device whereby the holder can both support the nail and drive it into a surface area without using a separate hammer tool.

A further object is to provide a nail holder that is economical in cost to manufacture.

A still further object is to provide a nail holder that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
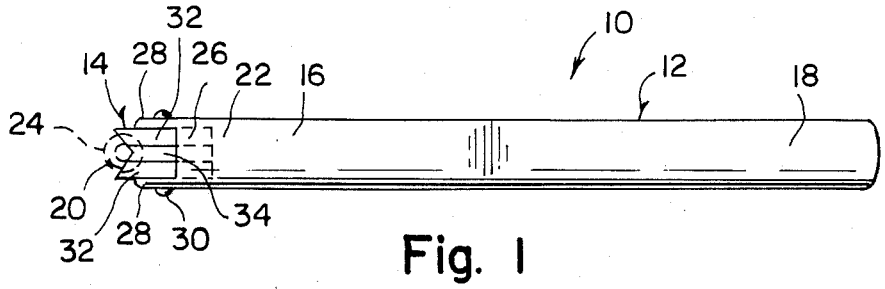
FIG. 1 is a top view of the invention.
Figure 2:
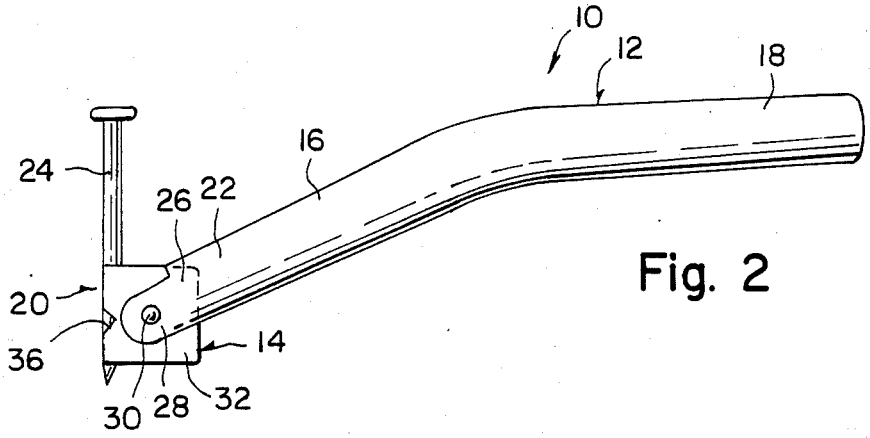
FIG. 2 is a side view thereof.

Turning now descriptively to the drawings, in which similar reference characters denote similar elements throughout the several views, FIGS. 1 and 2 illustrate a nail holder 10 which consists of an elongated bent body member 12 and a magnetic head 14.

The elongated bent body member 12 has a neck portion 16 and a handle portion 18. The handle portion 18 is to be gripped by a hand (not shown) of a user of the nail holder 10.

The magnetic head 14 has a V-shaped slot 20 therein. The magnetic head 14 is affixed to free end 22 of the neck portion 16 so that the V-shaped slot 20 is generally at a right angle to the handle portion 18. The V-shaped slot 20 is used to hold a nail 24 in any desired direction while the nail 24 is partially hammered into a surface area (not shown) such as wood, plastic, etc. The magnetic head 14 can be pulled away from the nail 24 and the nail can be completely hammered into the surface area.

The neck portion 16 has a forked end 26 with the magnetic head 14 positioned between furcations 28 of the forked end 26. At least one rivet pin 30 is mounted through the magnetic head 14 and the furcations 28 of the forked end 26.

Figure 4:
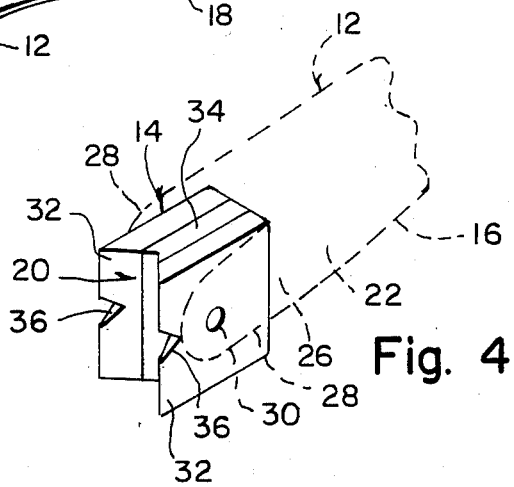
FIG. 4 is an enlarged perspective view of just the nail holder head with the handle shown in phantom. de

As best seen in FIG. 4, the magnetic head 14 includes a pair of steel plates 32 and a magnetic plate 34 sandwiched between the steel plates 32. The magnetic plate 34 employs a magnetic field at the V-shaped slot 20 at forward edges of the plates.

Each steel plate 32 further has a transverse V-shaped notch 36 at the forward edge. The magnetic head 14 can hold a tack (not shown) an any desired direction while the tack is partially hammered into the surface area so that the magnetic head 14 can be pulled away from the tack and the tack can be completely hammered into the surface area.

Figure 3:
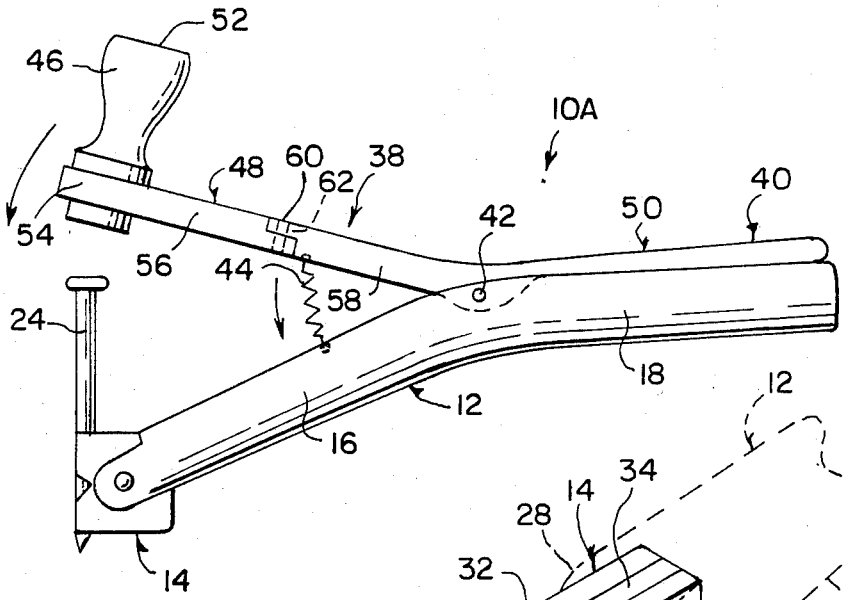
FIG. 3 is a side view of a modification similar to FIG. 2 showing a built in hammering device.

FIG. 3 shows a modified nail holder 10A that contains a built in hammering device 38. The nail holder 10A can both hold the nail 24 or tack and partially hammer it into the surface area without using a separate hammer tool. The hammering device 38 consists of an elongated bent arm member 40, a pivot pin 42, a compression spring 44 and a weighted hammer head 46.

The elongated bent arm member 40 has a forward portion 48 and a rearward portion 50. The pivot pin 42 is mounted through junction of the neck portion 16 and the handle portion 18 of the body member 12 and through junction of the forward portion 48 and rearward portion 50 of the arm member 40. The forward portion 48 and the rearward portion 50 will extend away from the body member 12.

The compression spring 44 is mounted between the neck portion 16 of the body member 12 and the forward portion 48 of the arm member 40. The forward portion 48 will normally be pulled against the neck portion 16 while the rearward portion 50 will be pulled away from the handle portion 18, (which is the reverse of what is shown in FIG. 2).

The weighted hammer head 46 has a flat top 52 and is affixed to free end 54 of the forward portion 48 of the arm member 40 in which the hammer head 46 will make contact with the nail 24 in the magnetic head 14. The ha-mer head 46 can hammer the nail into the surface area is three different ways. The first way is by the hand of the user pressing and releasing the rearward portion 50 with respect to the handle portion 18. The second way is by the hand of the user pulling and releasing the hammer head 46. The third way is by a remote hammer tool (not shown) striking the flat top 52 of the hammer head 46.

The forward portion 48 of the arm member 40 is divided into two sections 56, 58 having a lateral pivot area 60 therebetween.

A lateral pivot pin 62 is mounted through the lateral pivot pin 62 is mounted through the lateral pivot area 60. The section 56 with the weighted hammer head 46 can laterally pivot away to provide unobstructed access to the nail 24 by the remote hammer tool.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A nail holder which comprises:

(a) an elongated bent body member having a neck portion and a handle portion, said handle portion to be gripped by a hand of a user of said nail holder; and (b) a magnetic head having a V-shaped slot therein, said magnetic head affixed to free end of said neck portion so that said V-shaped slot is generally at a right angle to said handle portion, said V-shaped slot used to hold a nail in any desired direction while said nail is partially hammered into a surface area so that said magnetic head can be pulled away from said nail and said nail can be completely hammered into said surface area, further comprising:

(c) said neck portion having a forked end with said magnetic head positioned between furcations of said forked end; and (d) at least one rivet pin mounted through the magnetic head and said furcations of said forked end, wherein said magnetic head includes a pair of steel plates and a magnetic plate sandwiched between said steel plates which employs a magnetic field at said V-shaped slot at forward edges of said plates, wherein each said steel plate further having a transverse V-shaped notch at said forward edge so that said magnetic head can hold a tack in any desired direction while said tack is partially hammered into said surface area so that said magnetic head can be pulled away from said tack and said tack can be completely hammered into said surface area, further comprising a built in hammering device whereby said nail holder can both hold said nail/-tack and partially hammer into said surface area without using a separate hammer tool, wherein said hammering device comprises:

(e) an elonagated bent arm member having a forward portion and a rearward portion;

(f) a pivot pin mounted through junction of said neck portion and said handle portion of said body member and through junction of said forward portion and said rearward portion of said arm member so that said forward portion and said rearward portion will extend away from said body member;

(g) a compression spring mounted between said neck portion of said body member and said forward portion of said arm member so that said forward portion will normally be pulled against said neck portion while said rearward portion will be pulled away from said handle portion; and (h) a weighted hammer head having a flat top affixed to free end of said forward portion of said arm member in which said hammer head will make contact with said nail in said magnetic head and can hammer said nail into said surface area by said hand of said user pressing and releasing said rearward portion with respect to said handle portion, said hand of said user pulling and releasing said hammer head and a remote hammer tool striking said flat top of said hammer head.

2. A nail holder as recited in claim 1, wherein said hammering device further comprises:

(i) said forward portion of said arm member divided into two sections having a lateral pivot area therebetween; and (j) a lateral pivot pin mounted through said lateral pivot area so that said section with said weighted hammer head can laterally pivot away to provide unobstructed access to said nail by said remote hammer tool.

* * * * *